United States Patent [19]

Terzian et al.

[11] 4,204,613

[45] May 27, 1980

[54] LIQUID COOLING AND DISPENSING DEVICE

[75] Inventors: Rouben T. Terzian; Douglas P. Montague, both of Chicago; Howard J. Morrison, Deerfield, all of Ill.

[73] Assignee: Marvin Glass & Associates, Chicago, Ill.

[21] Appl. No.: 885,852

[22] Filed: Mar. 13, 1978

[51] Int. Cl.[2] ..... B67D 5/62

[52] U.S. Cl. ..... 222/146 C; 165/170; 62/400

[58] Field of Search ..... 222/146 C, 146 R; 141/291, 292; 165/169, 170; 62/391, 398, 399, 400

[56] References Cited

U.S. PATENT DOCUMENTS

| | | | |
|---|---|---|---|
| 468,050 | 2/1892 | Trabold | 165/170 |
| 735,295 | 8/1903 | Price | 62/399 X |
| 1,207,278 | 12/1916 | Cordley | 222/146 C |
| 1,318,875 | 10/1919 | Hutchinson | 165/170 |
| 3,250,433 | 5/1966 | Christine et al. | 222/146 C |
| 3,865,276 | 2/1975 | Thompson | 222/146 C |
| 3,933,275 | 1/1976 | Metzner | 222/146 C |

*Primary Examiner*—Allen N. Knowles

*Attorney, Agent, or Firm*—Mason, Kolehmainen, Rathburn & Wyss

[57] ABSTRACT

A device for chilling fluids includes a cooling chamber for containing cooling media such as ice or the like. The wall of the cooling chamber includes a mounting arm for supporting a container of fluid generally in an inverted position. A fluid conduit is positioned within the cooling chamber in contact with the cooling media. The fluid conduit includes a removable coupler at its upper end for coupling the open end of the fluid container to the conduit and a check valve to prevent accidental spilling of the container. The lower end of the conduit includes a valve to allow selective flow of fluid from the container into the conduit for cooling and out through the valve into a suitable receptacle such as a drinking glass. In an alternate embodiment, the cooling chamber is generally rectangular in shape and the fluid conduit comprises a thin, sloping heat exchange element mounted within the cooling chamber. The heat exchange unit includes a sinuous path for the fluid and, preferably, a flat metal side for engagement with fluid on one side and ice on the other to transfer heat away from the fluid being cooled. The flat metal plate is preferably removable to facilitate cleaning of the inner path.

20 Claims, 12 Drawing Figures

18
14
16
10
12
34
20
22
60
58
28
3
40
48
15
30
24
26
38
36
32
42
46
68
56
64
44
66
31
54
52
62

LIQUID COOLING AND DISPENSING DEVICE

BACKGROUND OF THE INVENTION

1. Field of the Invention

The device of the present invention relates to a new and improved device for cooling and dispensing fluid.

2. Description of the Prior Art

It is often desirable during parties or similar functions to dispense cool liquid such as wine from a bottle that has not been chilled prior to the party. Placing the full bottle of wine in an ice bucket will not rapidly cool the wine resulting in delayed serving of the wine or only partially chilled wine. An alternative procedure is to provide individual glasses of wine with ice, however, as the ice melts the wine is diluted thereby diminishing its taste.

Another prior art procedure is to pour the wine in a highly conductive reservoir surrounded by a cooling media such as ice, however, this is a rather complex procedure requiring a costly mechanism. In addition, the desirable taste of the wine is hampered due to the pouring and aerating of the wine. Other devices for cooling fluids have been shown in U.S. Pat. Nos. 1,663,684; 2,360,491; 1,248,705; 1,236,912; 305,523; 3,923,662 and 3,595,030, among others.

SUMMARY OF THE INVENTION

An object of the present invention is to provide a new and improved device for rapidly and conveniently chilling wine or a similar fluid.

The present invention is directed to a new and improved fluid chiller that includes a container for containing a cooling media. A fluid conduit is positioned within the container to pass through the cooling media. The fluid conduit includes an outlet at its lower end having a spigot for the dispensing of fluid and an inlet at the upper end. The inlet includes a removable coupler for coupling the open end of a fluid container such as a wine bottle to the fluid conduit. The coupler includes a check valve for allowing fluid flow through the coupler only upon securing the coupler to the inlet of the conduit.

The container for the cooling media also includes a support for supporting the fluid container in an upright, inverted position while the fluid container is coupled to the conduit.

In an alternate embodiment, a generally rectangular insulated housing provides the cooling chamber for supporting the cooling media or ice. A substantially thin heat exchange element is mounted at a slight incline within the rectangular housing and includes an internal, sinuous path. The path may be provided by a plastic or similar sheet of material which includes a plurality of upstanding, generally parallel ribs on the interior of a similar upstanding perimeter. A closure member, preferably manufactured of sheet stainless steel closes the heat exchange unit on its upper side so as to engage the cooling media and consequently cool the fluid within the heat exchange unit. A similar removable coupler is provided for mounting the fluid container on the device.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENTS

Figures 1, 2, 3:
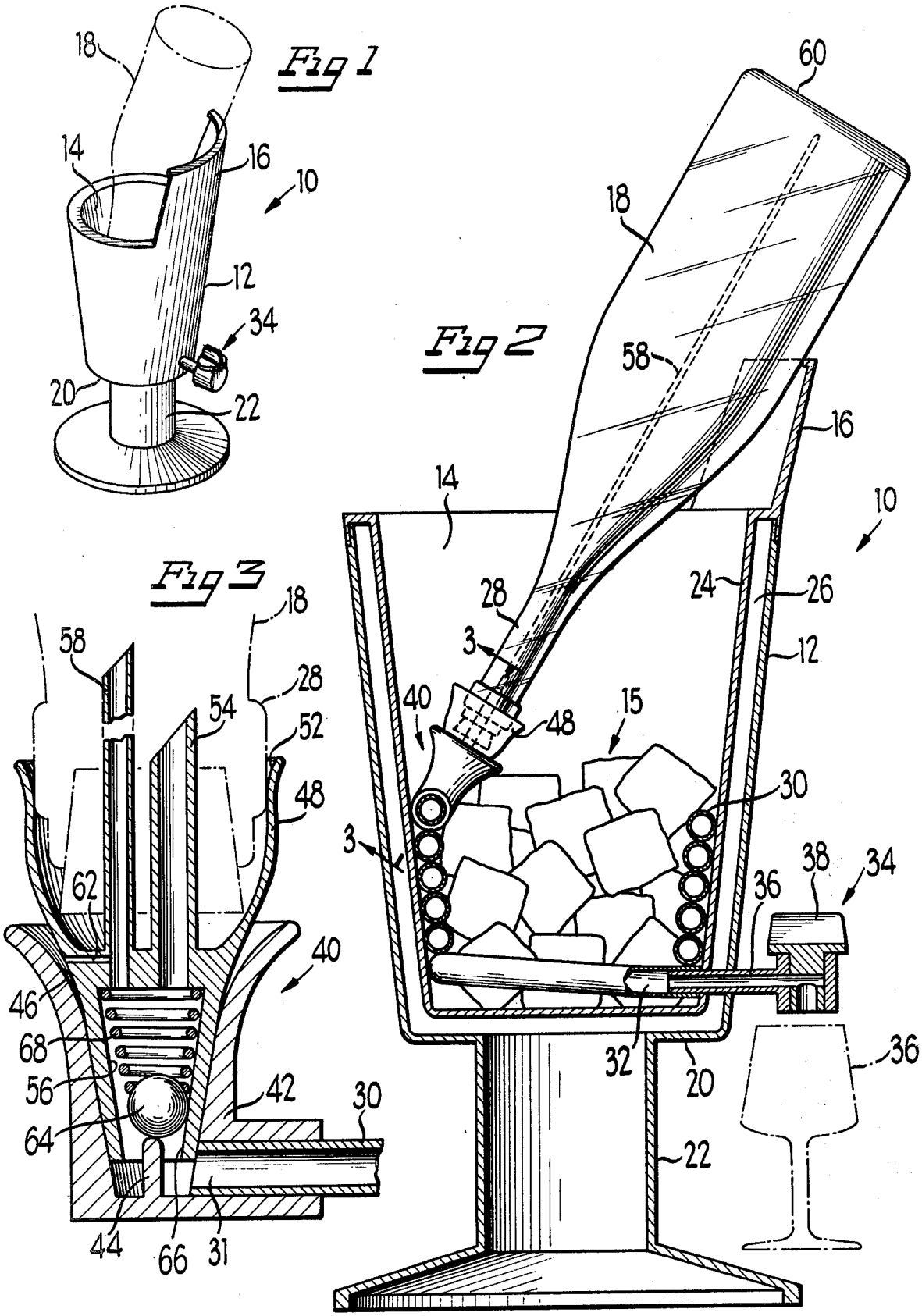
FIG. 1 is a perspective view of one embodiment of the liquid cooling and dispensing device, including a bottle of wine mounted therein, constructed in accordance with the principles of the present invention.
FIG. 2 is an enlarged, cross-sectional view of the device of the present invention including cooling media.
FIG. 3 is an enlarged, cross-sectional view of the coupling assembly taken along line 3—3 of FIG. 2.

Having reference now to the drawing, there is illustrated a device for chilling fluids such as wine, generally designated by the reference numeral 10. The wine chiller 10 includes a container 12 that has an opening 14 on the top to allow the introduction of cooling media such as ice 15.

In one embodiment, the container 12 is of the general configuration of an ice bucket and includes an integral flange 16 along one side thereof and adjacent to the opening 14 that may be employed to support a container of fluid such as a bottle of wine 18 in an inverted position within the container 12. The container 12 may stand positioned on its bottom 20 or preferably includes a pedestal 22 upon which it may be mounted. The container 12 is preferably insulated and may be of a dual wall construction having an inner wall 24 defining a trapped air space 26 between the inner wall 24 and the outer wall of the container 12.

The device 10 as best illustrated in FIG. 2 is adapted to hold a bottle 18, such as a wine bottle, in an inverted position such that is open end 28 extends into the interior of the container of bucket 12. The bottle 18 is removably coupled to a fluid conduit 30 positioned within the bucket 12 and, in the illustrated embodiment, mounted in a spiral configuration along the inner wall 24 and generally at the bottom of the bucket 12. In normal operation, the wine in the bottle 18 flows from the bottle and through the conduit 30 thus being exposed to the cooling media or ice 15 for chilling. This conduit 30 may be of aluminum, copper or other material which is highly heat conductive such that the temperature of the fluid, as it flows through the conduit 30, is rapidly reduced.

The conduit 30 has a lower outlet 32 that is coupled to a spigot generally designated by the reference numeral 34. The spigot 34 may also be made of aluminum and includes an inlet tube 36 coupled to the outlet 32. The spigot 34 includes a valve portion 38 that may be manually rotated to allow the fluid to flow through the spigot 34 into a glass 36 or similar container. After the glass 36 has been filled, the valve 38 may again be rotated to terminate flow.

The upper inlet 31 of the conduit 30 has attached thereto a coupling assembly generally designated by the reference numeral 40. The coupling assembly 40 connects the open end 28 of the wine bottle 18 to the conduit 30 to allow fluid flow therethrough for cooling by the cooling media 15. Means are provided by the coupler 40 to prevent the wine from spilling out of the inverted bottle 18 prior to coupling the bottle 18 to the conduit 30.

More particularly, the coupler 40 includes a female adapter 42 secured to the inlet 31 of the conduit 32. The adapter 42 includes a pin or engagement member 44 that extends into a generally bell-shaped recess 46 of the adapter 42. The coupler 40 further includes a flexible bottle end or male adapter 48 that is secured to the open end 28 of the bottle 18. The bottle adapter 48 includes a flange or skirt portion 52 that is adapted to surround and seal the open end 28 of the bottle 18. The flange 52 includes a short fluid tube 54 that extends into the open end 28 of the wine bottle 18 and allows fluid flow therethrough into a frusto-conical fluid chamber 56 defined within the flexible lower end of the bottle adapter 48 as shown in FIG. 3.

The bottle adapter 48 also includes an elongated air inlet tube 58 which extends approximately the full length of the bottle 18 and communicates with the bottom 60 of the bottle 18 to permit air to displace the fluid. In addition, the air inlet tube 58 includes a passage 62 through the side of the male adapter 48 to the atmosphere such that the bottom 60 of the wine bottle 18 is in fluid communication with the atmosphere.

The male adapter 48 includes a ball valve 64 that is biased into sealing engagement with an outlet 66 of the male adapter 48 by a spring 68. Accordingly, when the open end 28 of the wine bottle 18 is coupled to the male adapter 48, fluid may flow through the fluid tube 54 as a result of the air at the bottom of the bottle 60 communicated thereto by the air tube 58. The fluid may not, however, flow through the outlet 66 of the male adapter 48 when the ball valve 64 is biased into sealing engagement with the outlet 66 by the spring 68. Once the male adaptor 48 is positioned within the female adapter 42, the pin 44 engages the ball valve 64 forcing it against the bias of the spring 68 and away from the outlet 66 thereby allowing fluid flow into the conduit 30. As the fluid flows through the conduit 30, it is cooled by the cooling media 15 as fluid flow is controlled by the spigot 34.

The wine bottle may be removed from the adapter 40 by removal of the male adapter 48 out of the female adapter 42. As this occurs, the ball valve 64 is allowed to reseal in the outlet 66 preventing spilling of the wine or other fluid from the bottle 18.

Figure 4:
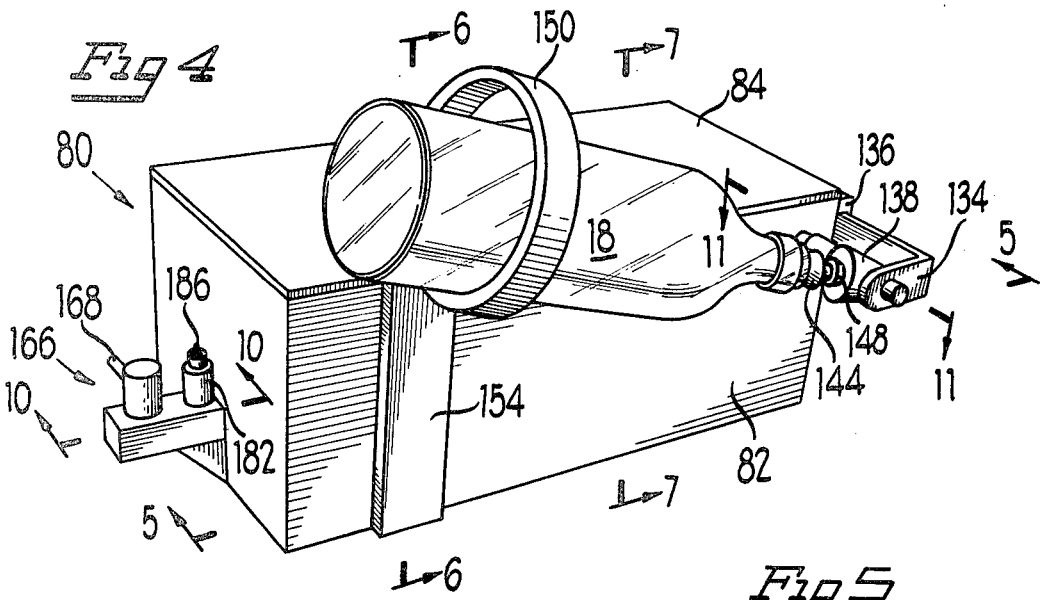
FIG. 4 is a perspective view of an alternate embodiment of the liquid cooling and dispensing device made in accordance with the concepts of the present invention.
Figure 5:
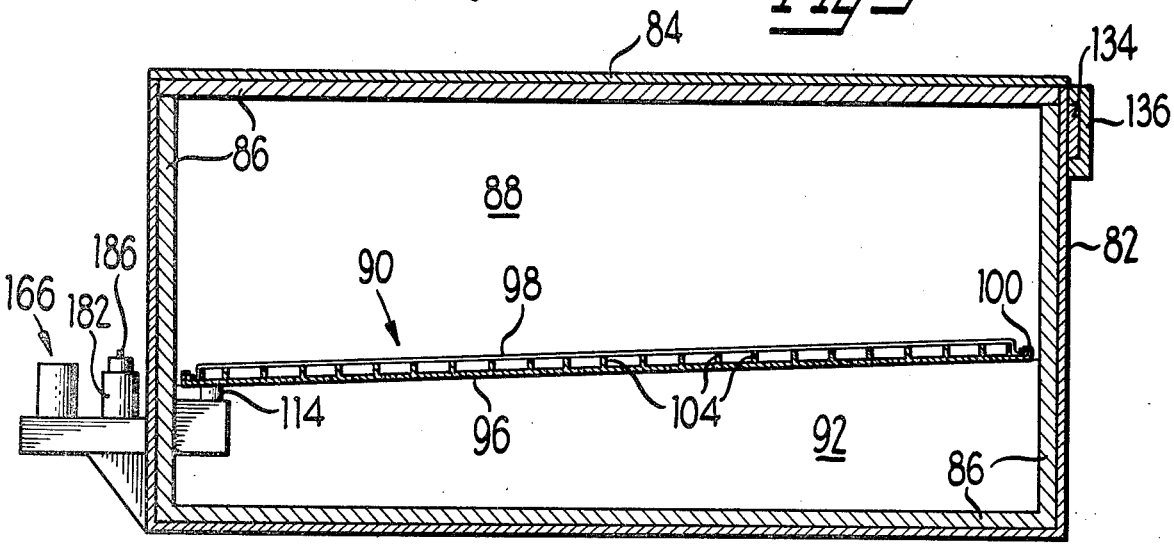
FIG. 5 is an enlarged vertical section, taken generally along line 5—5 of FIG. 4.
Figure 6:
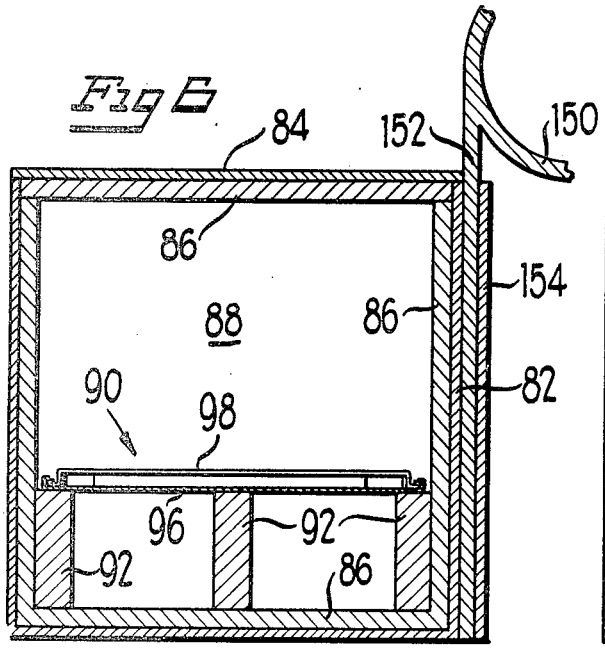
FIG. 6 is another vertical section taken generally along line 6—6 of FIG. 4.

An alternate embodiment of the fluid cooling and dispensing device is shown in FIG. 4, and generally designated by the reference numeral 80. The alternate embodiment includes a generally rectangular housing 82 which includes a removable top portion or cover 84. Referring to FIG. 5, the housing 82 and top 84 both include an interior lining of insulating material 86 which defines an interior volume 88 forming the cooling chamber. A heat exchange unit, generally designated 90, is mounted within the chamber 88 by a plurality of upstanding ribs 92 (FIGS. 6 and 7) which support the heat exchange unit 90 at a slight angle as shown in FIG. 5.

Figure 8:
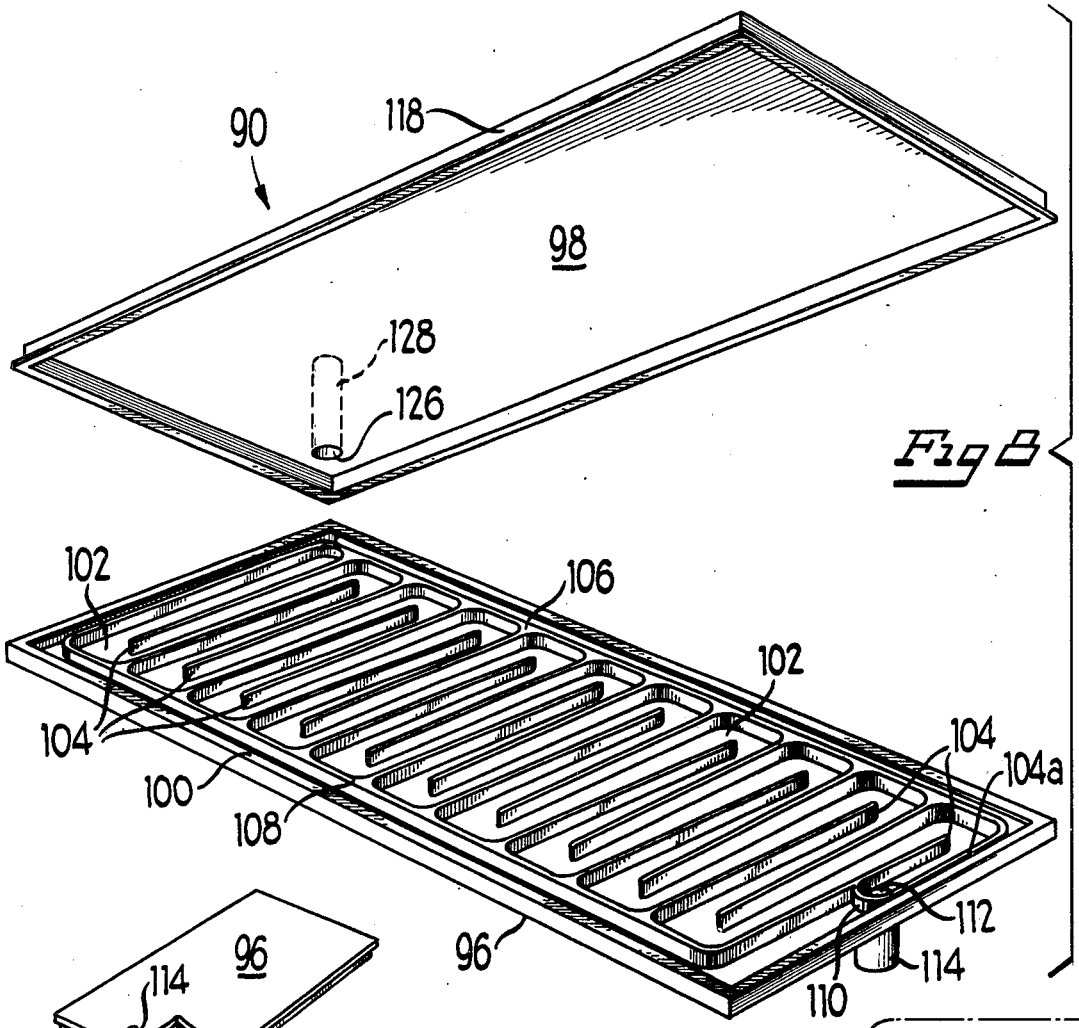
FIG. 8 is an exploded perspective view of the heat exchange unit of the alternate embodiment.

Referring now to FIG. 8, the heat exchange unit 90 includes a generally flat lower element 96 and a similar flat upper element or top 98. The lower element 96 is preferably formed of a resilient, deformable material such as plastic or the like with an integral outside upstanding perimeter or wall 100 as shown. A maze or sinuous path 102 is defined within this outer perimeter 100 by a plurality of upstanding, integral, transverse fins or flanges 104 which are alternately connected to similar longitudinal flanges 106 and 108 at opposite sides. The lowermost flange **104*a* shown generally in the right of FIG. 8 is connected to a semi-circular terminal flange 110 formed directly above an aperture 112 in the bottom wall which communicates with a discharge tube 114. The upper portion or top 98 is generally rectangular in shape and preferably formed of a highly thermal conductive material such as metal or the like. In one preferred embodiment, when the fluid cooling and dispensing device is used in an application as a wine chiller, the top 98** is preferably manufactured from stainless steel which avoids corrosion while maintaining sufficient heat transfer.

Figure 12:
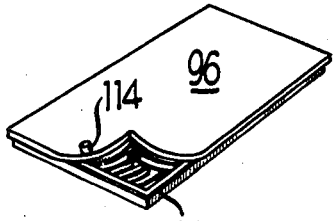
FIG. 12 is an assembled view of the heat exchange unit of FIG. 8 showing the manner in which the heat exchange unit is disassembled.
Figure 9:
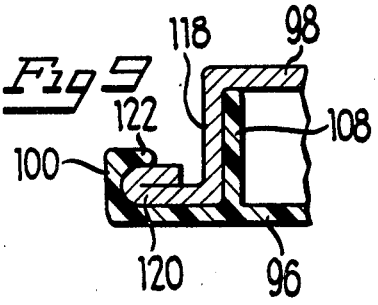
FIG. 9 is a partially fragmented vertical section showing the connecting means between the two portions of the heat exchange unit.
Figure 10:
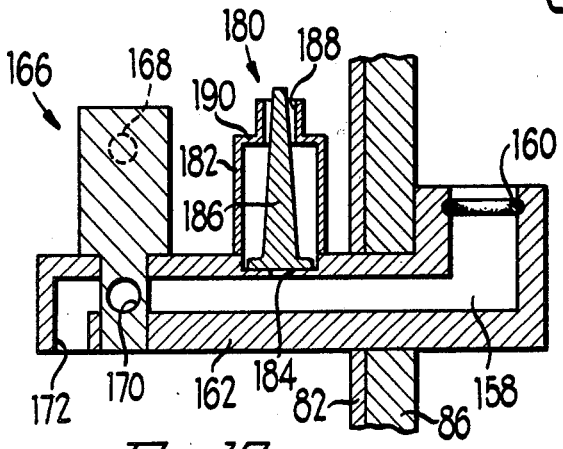
FIG. 10 is a vertical section taken generally along line 10—10 of FIG. 4.

The top 98 is formed with a depending flange 118 around its entire periphery, and, referring to FIG. 9, the depending flange terminates in a generally lateral or outwardly extending, curled, connecting element 120. The peripheral wall 100 of the lower portion includes an inwardly directed flange element 122 which is flexible enough to permit the connecting element 120 around the perimeter flange 118 to be frictionally inserted and captivated therein. As shown in FIG. 12, the upper and lower portions of the heat exchange unit 90 can thus be disassembled for cleaning the fluid path between the flanges 104.

Figure 7:
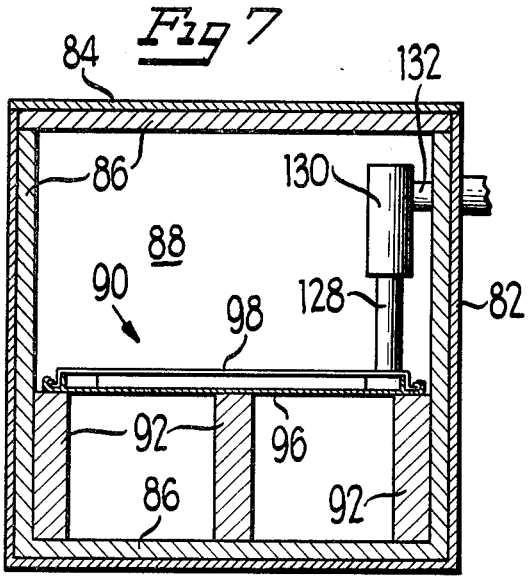
FIG. 7 is another vertical section, taken generally along line 7—7 of FIG. 4.
Figure 11:
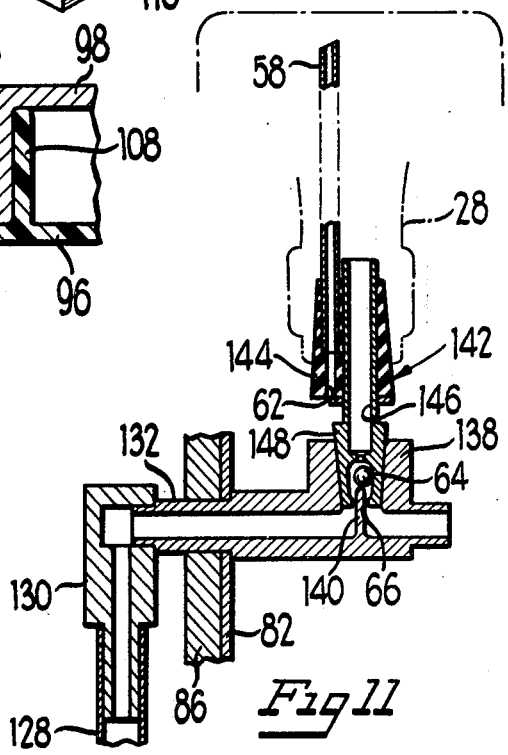
FIG. 11 is another vertical section taken generally along line 11—11 of FIG. 4.

Referring to FIGS. 8 and 7, the top 98 is provided with an aperture 126 in communication with a generally vertical tube 128. The tube 128 is connected by a fitting 130 to a horizontally extending inlet conduit 132 as seen in FIG. 11. The horizontally extending inlet conduit 132 is removable and extends through the side wall of the housing 82 where its outer end is supported by an L-shaped flange 134. The elongated portion of the L-shaped flange 134 extends through a slot formed by a U-shaped mounting element 136 on the exterior of the housing 82 as shown in FIGS. 4 and 5. As with the prior embodiment, the inlet conduit 132 includes a female adapter portion 138 provided on the opposite side of the tube from an upstanding post or pin 140. A bottle connector, generally designated 142, is provided to connect a typical liquid container, such as a wine bottle, to the female connector 138 in a similar manner as described with respect to FIG. 3 previously.

The connector 142 includes a tapered rubber or cork element 144 which is positioned and frictionally maintained within the open end of a bottle and includes an inlet tube 146 for transferring fluid from the bottle to the heat exchange unit 90. The connector includes a similar generally frusto-conical flexible male adapter 148 which provides a leak-proof, frictional seal with the female adapter 138 on the inlet conduit 132. Again, the adapter portion 148 includes a valve having a ball 64 which, due to gravity, seals the end opening 66 of the male adapter until insertion into the female adapter 138 causes the pin 140 to raise the ball 64 and thus permit fluid flow. A similar air inlet tube or valve 58 in communication through an opening 62 permits air to enter into the bottom of the bottle to permit continuous flow as described before.

The fluid container or wine bottle 18 is supported at its rear end within a ring 150 which is slidably mounted by a rectangular support arm 152 within another slot formed by a vertical U-shaped member 154 mounted on the side of the housing. When the fluid cooling and dispensing device 80 is not in use, the ring support 150, inlet conduit 132, and the L-shaped support 134 can be slidably removed from their respective supports and stored within the rectangular housing compartment 88.

As described previously, the lowermost end of the heat exchange unit 90 includes a depending exit tube 114 which mates with an outlet conduit 158 which includes a resilient "O-ring" 160 for sealing the discharge tube 114. A horizontal portion 162 of the discharge conduit 158 terminates in a similar spigot-type valve, generally designated 166, which is manually rotated by means of a handle 168 to align an aperture 170 with the discharge tube 158 to permit the fluid to discharge downwardly through the opening 172 and into a user's glass or other container positioned therebelow.

In addition, at the beginning of use, when a fluid container is first secured to the inlet conduit 132, the heat exchange unit 90 will normally be full of encapsulated air. Thus, an air release valve, generally designated 180 is provided to permit the initial escapement of air from the heat exchange unit 90. The valve includes a generally cylindrical vertical chamber defined by a cylindrical wall 182. The interior thereof is in communication with the conduit 158 through an aperture 184. The aperture 184 is closed by an upwardly extending, tapered float 186 which extends through a similar aperture 188 in the top circular wall 190. As air initially travels into the conduit 158, the float 186 is lifted slightly by the air pressure to permit air to flow upwardly into the cylindrical chamber and out through the aperture 188. However, when the liquid has finally filled the heat exchange unit in the conduit 58, the substantially lightweight float is lifted to seal the aperture 188 with its tapered surfaces, thus preventing any escape of the liquid. Of course, the air escape valve 180 could be eliminated and the user could initially bleed the system through the use of the spigot 166.

While the invention has been described with reference to details of the illustrated embodiment, it should be understood that such details are not intended to limit the scope of the invention as defined in the following claims.

What is claimed and desired to be secured by Letters Patent of the United States is:

1. A fluid cooling and dispensing device, comprising:

an insulated container defining a cooling chamber for containing a suitable cooling media such as ice;

heat transfer means defined in said container for circulating fluid through said cooling media, said heat transfer means including a fluid inlet and a fluid dispenser;

a selectively operable valve having a first end adapted to be coupled to said fluid inlet and a second end adapted to be coupled to a container of fluid, said valve including air vent means communicating with the atmosphere and the interior of said container of fluid; and shutoff means including a movable valve element and a post in said fluid inlet engageable therewith for moving said valve element to an open position upon coupling said first end to said fluid inlet thereby allowing fluid flow through said valve and said circulating means.

2. The dispensing device of claim 1 wherein said container is generally of a bucket configuration including a support flange for supporting said container of fluid.

3. The dispensing device of claim 1 wherein said container is generally rectangular in shape including a cover for closing the top thereof.

4. The dispensing device of claim 1 wherein said heat transfer means includes a fluid conduit having a generally coiled configuration and positioned within said container.

5. A dispensing device for cooling and dispensing fluid from a suitable fluid container, such as a bottle or the like, comprising:

a vessel for containing a cooling media including support means on said vessel for supporting said fluid container in a generally inverted position within said vessel;

a conduit within said vessel in contact with cooling media therein, said conduit including a fluid inlet and outlet; and valve means for removably connecting said fluid container to the conduit inlet, said valve means including a valve outlet, an elongated vent tube which extends into said fluid container for venting said fluid container to the atmosphere, and a movable element for movement into sealing engagement with the outlet of said valve to prevent fluid flow through said valve, said conduit inlet including an engagement member for engaging said movable valve element to move said valve element out of sealing engagement with said valve outlet upon coupling of said valve to said inlet of said conduit.

6. The device claimed in claim 5 wherein said conduit is of a generally spiral configuration.

7. The device claimed in claim 6 wherein said outlet of said conduit includes a spigot for controlling the flow of fluid therethrough.

8. A liquid cooling and dispensing device for cooling and dispensing fluid from a suitable fluid container, comprising:

a housing for maintaining a cooling media, such as ice;

heat transfer means positionable within said housing, said heat transfer means including a fluid inlet, a fluid outlet, and a pair of generally flat end walls on opposite sides of a plurality of upstanding fins which defines a tortuous path;

means for removably connecting said container to said fluid inlet.

9. The device of claim 8 wherein at least one of said side walls is manufactured from a material having a high heat transfer characteristic.

10. The device of claim 8 including means removably securing said side walls into engagement with said fins to facilitate removal and cleaning thereof.

11. A heat transfer unit, comprising:

a substantially flat first wall;

a plurality of generally upstanding fins mounted on said first wall for defining a sinuous path of travel;

a substantially flat second wall for mounting on said first wall to define a closed, substantially flat path of travel between said walls and fins wherein said fins and first wall are integrally molded of resilient plastic material; and connection means between said first and second wall for sealing the same by engagement of said resilient material with said second wall.

12. The device of claim 11 wherein at least one of said side walls is manufactured from a material having a high heat transfer characteristic.

13. The device of claim 11 including means removably securing said walls into engagement with said fins to facilitate removal and cleaning thereof.

14. The heat transfer unit of claim 11 wherein said connection means comprises a flange on said second wall and a complementary flange enclosing groove on said first wall for hermetically sealing said first and second walls at said connection means.

15. A fluid cooling and dispensing device for use with a fluid container, comprising:

a housing defining a chamber for supporting a cooling media;

a conduit having an inlet and an outlet positioned within said chamber in a heat transfer relationship with said cooling media;

a check valve to prevent leakage of fluid from said container prior to connection thereof with said conduit inlet;

a coupler for removably connecting the fluid container to the conduit inlet, said conduit including means for connection thereof to the fluid container so that fluid will pass therethrough into the conduit outlet and be cooled by the cooling media;

complementary means for sealingly engaging said check valve upon connection of the coupler thereto and means for opening said check valve to allow fluid flow from the container into said conduit, said check valve including a movable element, a valve seat, and means for biasing the movable element into engagement with the valve seat;

valve release means on the complementary means for moving the movable valve element out of engagement with said valve seat upon the connection of the coupler thereto, said valve release means comprising an upstanding part which engages the movable element upon connection of the coupler with the complementary means; and means for venting the inside of said fluid container to the atmosphere.

16. The dispensing device of claim 15 wherein said housing chamber includes means for holding said fluid container generally in an inverted position.

17. The dispensing device of claim 15 wherein said conduit outlet includes manually operable flow control means for controlling the flow of fluid therethrough.

18. The dispensing device of claim 15 wherein said housing is insulated.

19. A fluid cooling and dispensing device, comprising:

an insulated container defining a cooling chamber for containing a suitable cooling media, such as ice;

heat transfer means defined in said container for circulating fluid through the cooling media, said heat transfer means including a fluid inlet, a fluid dispenser, and means defining a flat, sinuous path of travel for said fluid mounted at an angle relative to said container; and a selectively operable valve having a first end adapted to be coupled to said fluid inlet and a second end adapted to be coupled to a fluid container, said valve including shutoff means to selectively prevent fluid flow therethrough.

20. A fluid cooling and dispensing device, comprising:

a container defining a cooling chamber for containing a suitable cooling media;

heat transfer means defined in said container for circulating fluid through the cooling media, the heat transfer means comprising a fluid inlet, a fluid dispenser, and means defining a flat tortuous path of travel generally along a plane positioned at an angle so as to induce gravity flow of the fluid therethrough; and a selectively operable valve means having a first end adapted to be coupled to said fluid inlet and a second end adapted to be coupled to said fluid container, said valve including shutoff means to selectively prevent fluid flow therethrough.

* * * * *